US010631633B1

(12) United States Patent
Holmes

(10) Patent No.: US 10,631,633 B1
(45) Date of Patent: Apr. 28, 2020

(54) FOLDABLE LAP TABLE ASSEMBLY

(71) Applicant: Isaac Holmes, Ashland, AL (US)

(72) Inventor: Isaac Holmes, Ashland, AL (US)

( * ) Notice: Subject to any disclaimer, the term of this patent is extended or adjusted under 35 U.S.C. 154(b) by 0 days.

(21) Appl. No.: 16/286,699

(22) Filed: Feb. 27, 2019

(51) Int. Cl.
*A47B 23/00* (2006.01)

(52) U.S. Cl.
CPC .... *A47B 23/002* (2013.01); *A47B 2200/0037* (2013.01); *A47B 2200/0041* (2013.01)

(58) Field of Classification Search
CPC ..... A47B 23/001; A47B 23/002; A47B 2023/005; A47B 2200/0037
USPC ..... 108/43, 14, 35, 34, 38
See application file for complete search history.

(56) References Cited

U.S. PATENT DOCUMENTS 1,089,289 A * 3/1914 Thompson ..... A47B 13/023 108/150
1,334,792 A * 3/1920 Rankin ..... A47B 77/10 108/14
2,248,871 A * 7/1941 Howe ..... A47B 3/10 108/166
2,358,883 A * 9/1944 Rothschild ..... A47B 3/087 190/12 R
2,695,830 A * 11/1954 Oden ..... A63H 19/00 312/241
3,147,052 A * 9/1964 Carr ..... A47B 85/06 312/241
3,208,807 A * 9/1965 Becker ..... A47B 43/02 312/200
3,614,794 A * 10/1971 Rodgers ..... A47C 17/82 5/119
4,519,318 A * 5/1985 Weldon-Ming ..... A47B 47/06 108/159
4,565,403 A * 1/1986 Brown ..... A47B 83/02 297/3
4,833,999 A * 5/1989 Rhoades ..... A22C 25/06 108/150
5,427,292 A * 6/1995 Rousch ..... A47B 23/001 108/25
D362,246 S 9/1995 Evenson
5,470,041 A 11/1995 Cucinotta
6,352,233 B1 3/2002 Barberich
6,701,851 B2 3/2004 Ibrahim
7,677,518 B2 3/2010 Chouinard
8,276,525 B2 10/2012 Janssen
9,345,338 B1 5/2016 Arch
2004/0045482 A1* 3/2004 Chalmers ..... A47B 23/002 108/12
2008/0054149 A1 3/2008 Freebairn
(Continued)

FOREIGN PATENT DOCUMENTS

WO WO2009124523 10/2009

*Primary Examiner* — Jose V Chen

(57) ABSTRACT

A foldable lap table assembly for creating storable and adjustable height table surfaces includes a top table and a pair of top legs hinged to the top table and a bottom table with a pair of bottom legs hinged to the bottom table. A storage configuration is defined by the bottom table with the pair of bottom legs in a bottom folded position receiving the top table with the pair of top legs in a top folded position to form a rectangular prism. An alternate box configuration is defined by the pair of top legs in an alternate top extended position engaging a bottom upper face of the bottom table to form a rectangular prism with an open front and an open back.

6 Claims, 9 Drawing Sheets

(56) References Cited

U.S. PATENT DOCUMENTS

| | | | | |
|---|---|---|---|---|
| 2009/0314189 | A1* | 12/2009 | Meharg | A47B 23/002 108/129 |
| 2010/0294177 | A1 | 11/2010 | Carney | |
| 2011/0219988 | A1* | 9/2011 | Stephens | A47B 9/00 108/6 |
| 2014/0251866 | A1* | 9/2014 | Smallman | B65D 1/34 206/557 |

* cited by examiner

FOLDABLE LAP TABLE ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to table and more particularly pertains to a new table for creating storable and adjustable height table surfaces.

BRIEF SUMMARY OF THE INVENTION

An embodiment of the disclosure meets the needs presented above by generally comprising a top table having a top left side, a top right side, a top front side, a top back side, a top upper face, and a top lower face. The top left side and the top right side perpendicularly extend beyond the top lower face. The top lower face has a raised section extending from the top front side to the top back side, medially positioned between the top left side and the top right side. A pair of top legs is coupled to the top table. Each of the pair of top legs has a top hinge coupled to either the top left side or the top right side adjacent the top lower face and swingingly moves between a top folded position adjacent the top lower face and an alternate top extended position coplanar with either the top left side or the top right side. Each of the pair of top legs has a top outer channel adjacent a top proximal edge and a top inner channel adjacent a top distal edge. The top outer channel and the top inner channel extend from a top front edge to a top back edge. The top outer channel receives either the top left side or the top right side in the alternate top extended position and the top inner channel receives the raised section of the top lower face in the top folded position. A bottom table has a bottom left side, a bottom right side, a bottom front side, a bottom back side, a bottom upper face, and a bottom lower face. The bottom front side and the bottom back side perpendicularly extend beyond the bottom upper face. A pair of bottom legs is coupled to the bottom table. Each of the pair of bottom legs has a bottom hinge coupled to either the bottom front side or the bottom back side adjacent the bottom upper face and swingingly moves between a bottom folded position adjacent the bottom upper face and an alternate bottom extended position coplanar with either the bottom front side or the bottom back side. Each of the pair of bottom legs has a bottom outer channel adjacent a bottom proximal edge extending from a bottom left edge to a bottom right edge. The bottom outer channel receives either the bottom front side or the bottom back side in the alternate bottom extended position. A storage configuration is defined by the bottom table with the pair of bottom legs in the bottom folded position receiving the top table with the pair of top legs in the top folded position on the bottom upper face between the bottom front side and the bottom back side to form a rectangular prism. An alternate box configuration is defined by the top distal edge of the pair of top legs in the alternate top extended position engaging the bottom upper face between the bottom front side and the bottom back side to form a rectangular prism with an open front and an open back.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
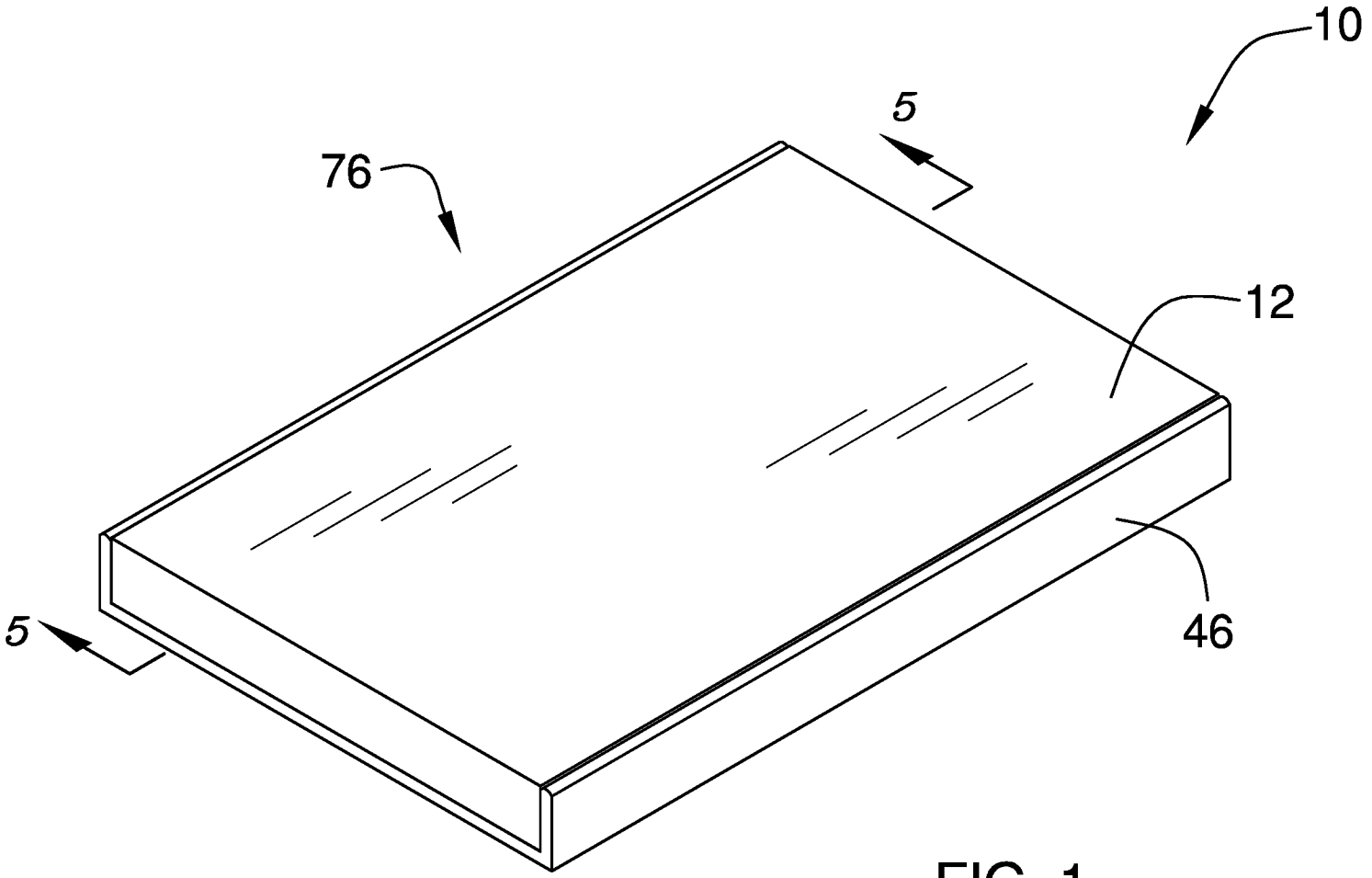
FIG. 1 is an isometric view of a foldable lap table assembly according to an embodiment of the disclosure.
Figure 2:
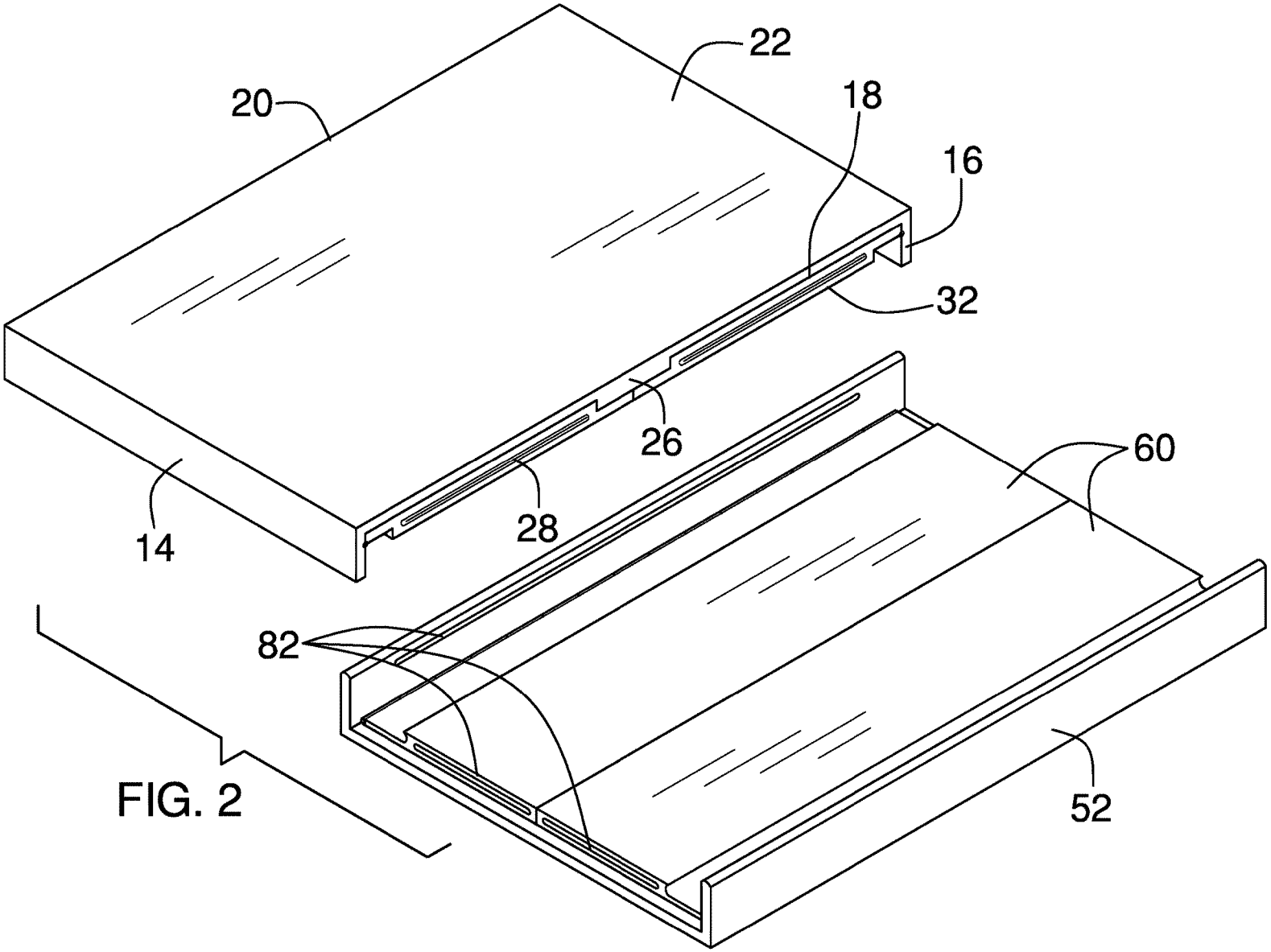
FIG. 2 is an exploded isometric view of an embodiment of the disclosure.
Figure 3:
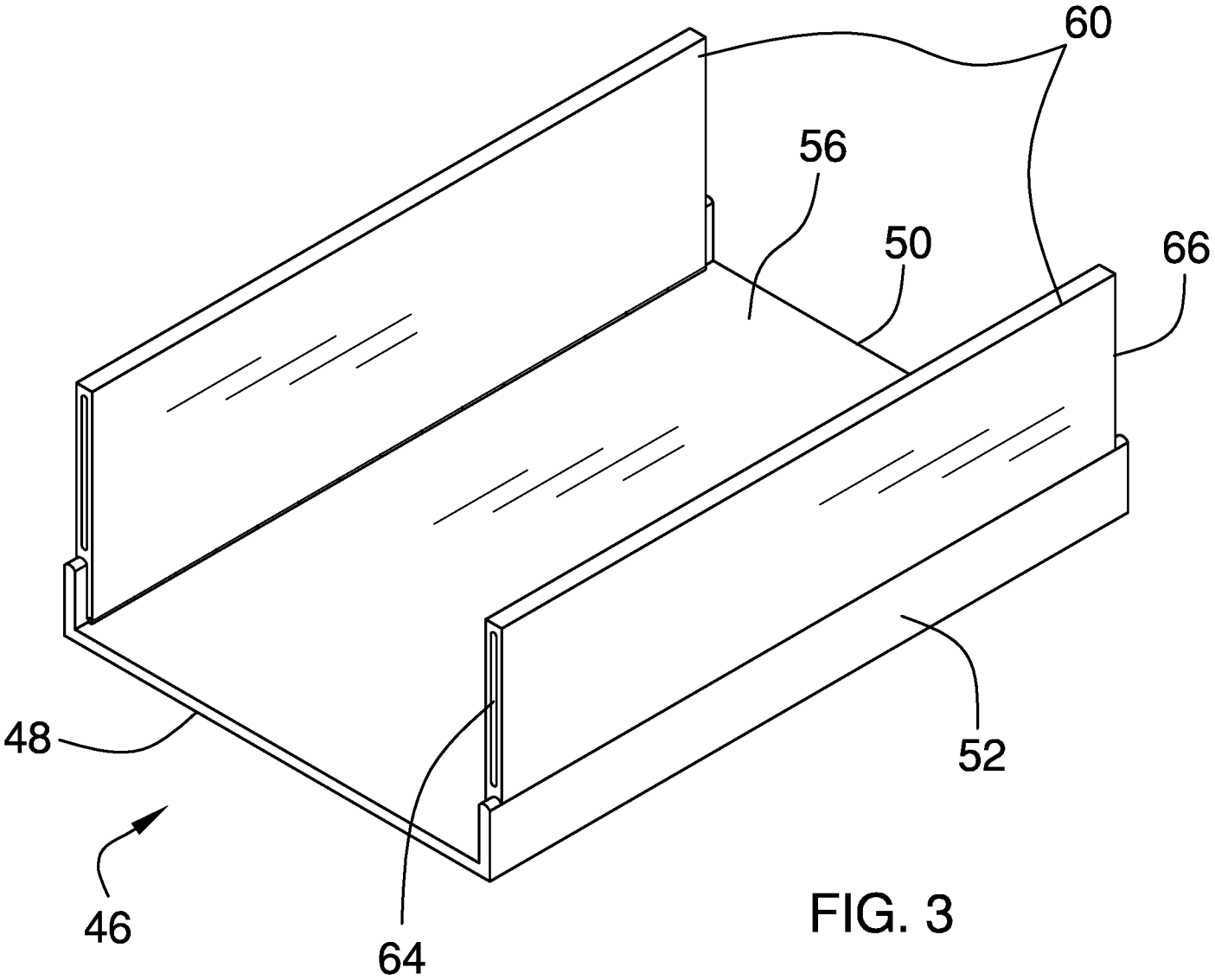
FIG. 3 is an isometric view of an embodiment of the disclosure.
Figure 4:
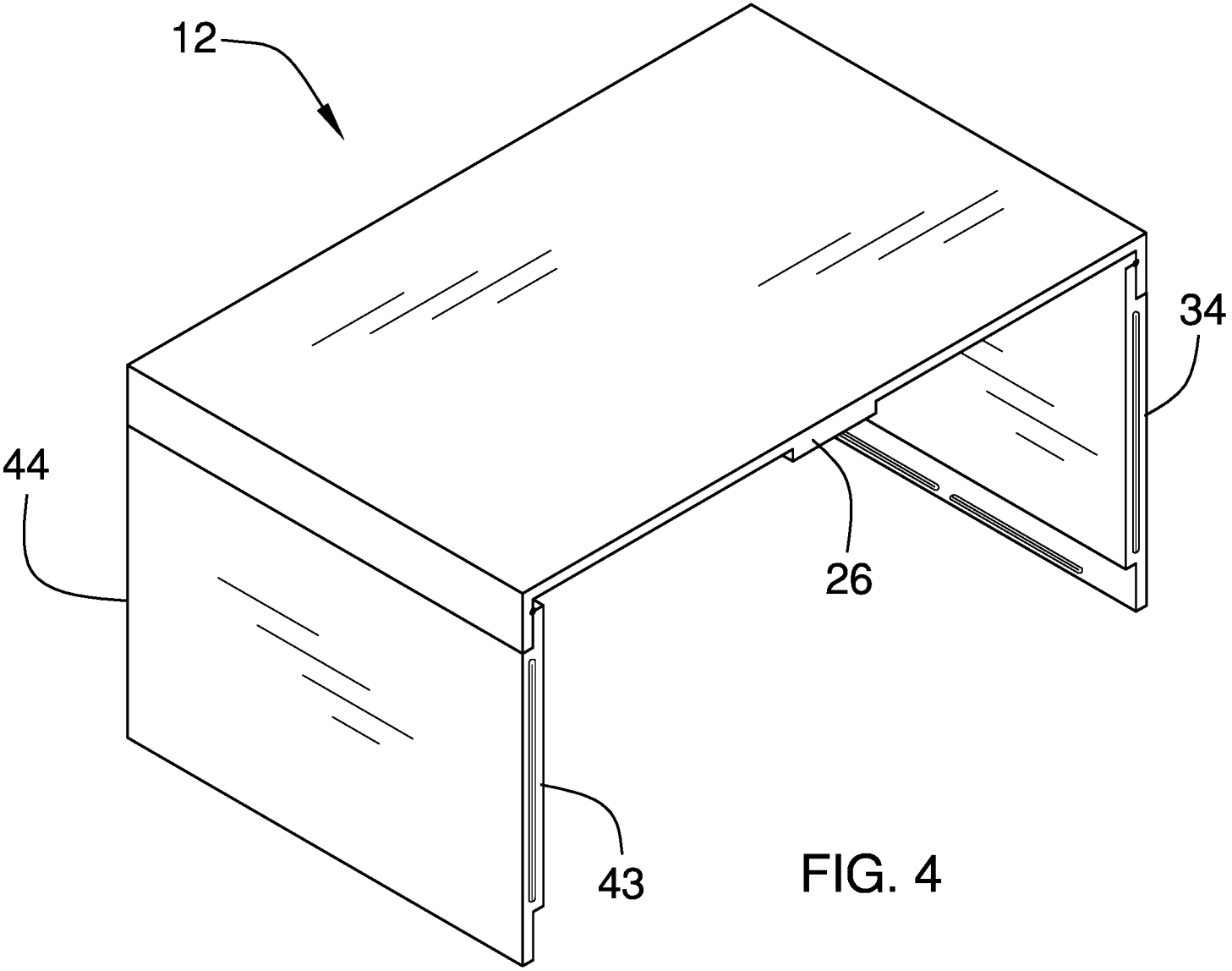
FIG. 4 is an isometric view of an embodiment of the disclosure.
Figure 5:
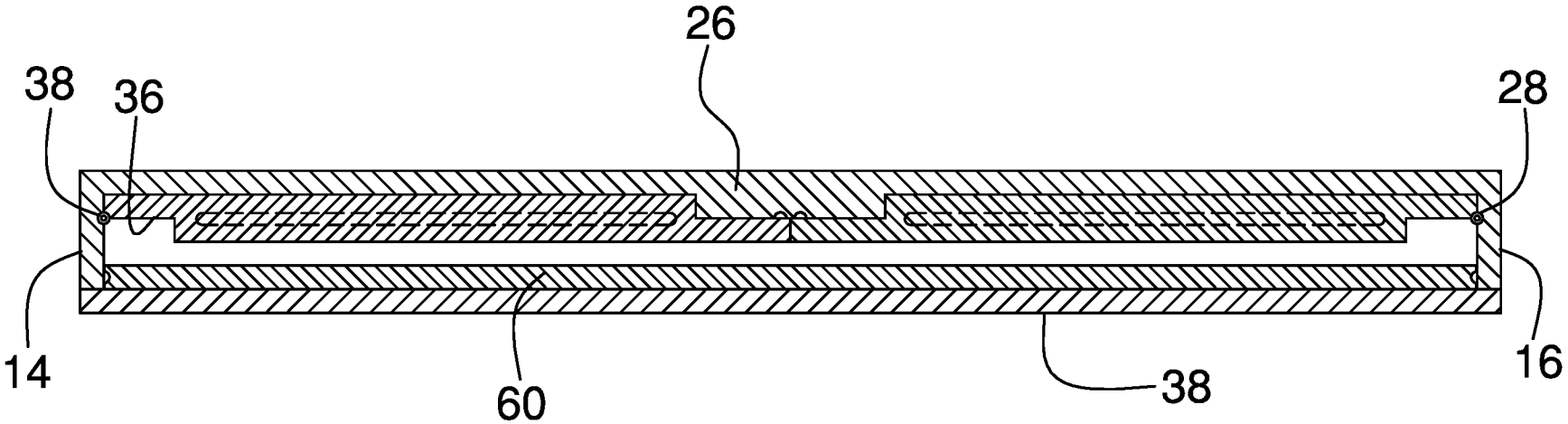
FIG. 5 is a cross-sectional view of an embodiment of the disclosure along line 5-5 of FIG. 1.
Figure 6:
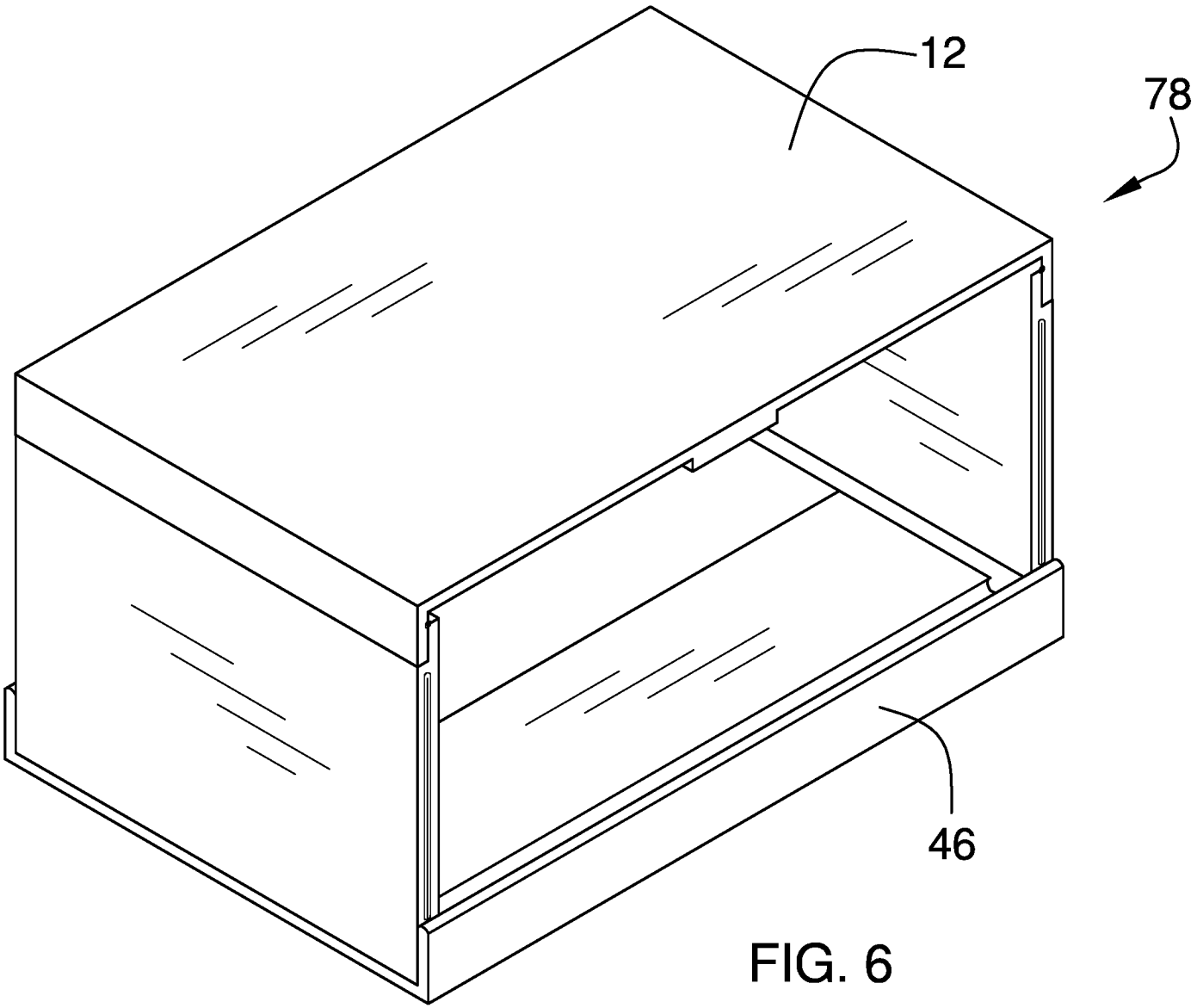
FIG. 6 is an isometric view of an embodiment of the disclosure.
Figure 7:
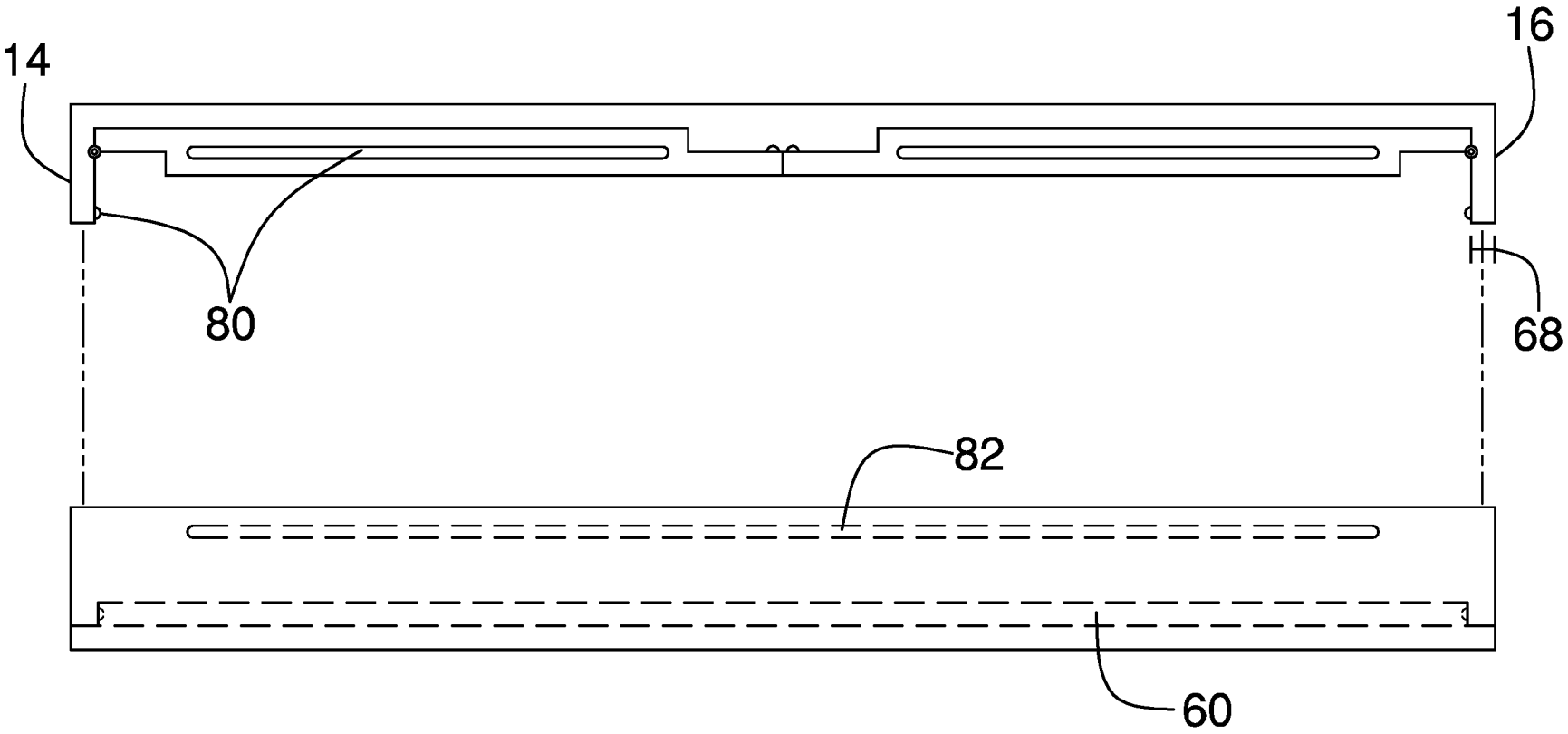
FIG. 7 is a front elevation view of an embodiment of the disclosure.
Figure 8:
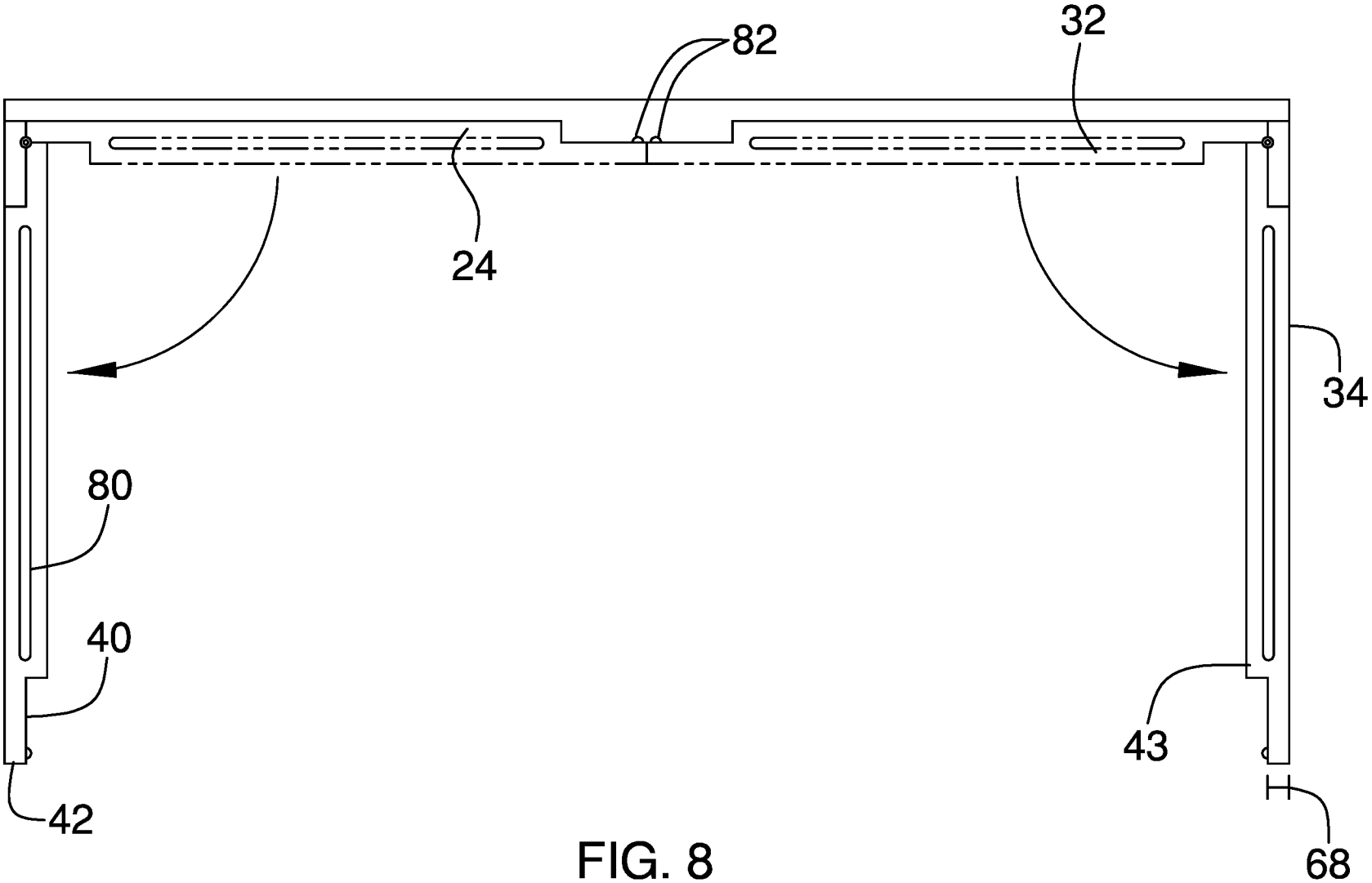
FIG. 8 is a front elevation view of an embodiment of the disclosure.
Figure 9:
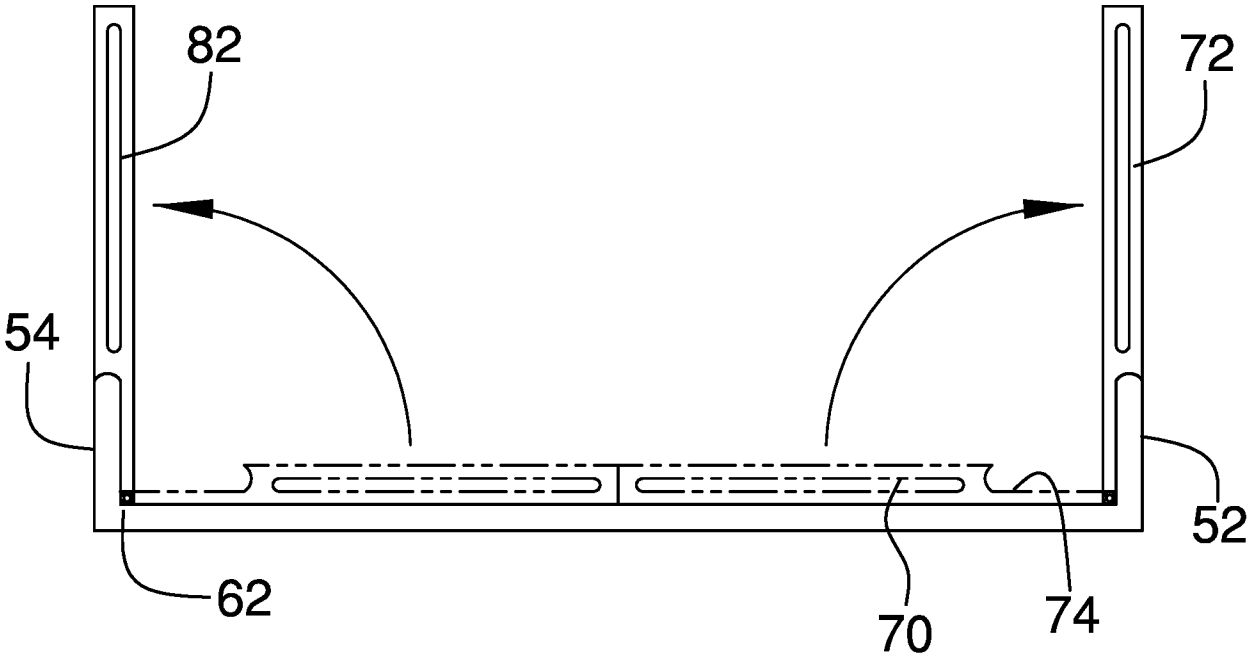
FIG. 9 is a front elevation view of an embodiment of the disclosure.

With reference now to the drawings, and in particular to FIGS. 1 through 9 thereof, a new table embodying the principles and concepts of an embodiment of the disclosure and generally designated by the reference numeral 10 will be described.

As best illustrated in FIGS. 1 through 9, the foldable lap table assembly 10 generally comprises a top table 12 having a top left side 14, a top right side 16, a top front side 18, a top back side 20, a top upper face 22, and a top lower face 24. The top left side 14 and the top right side 16 perpendicularly extend beyond the top lower face 24. The top lower face 24 has a raised section 26 extending from the top front side 18 to the top back side 20, medially positioned between the top left side 14 and the top right side 16. A pair of top legs 28 is coupled to the top table 12. Each of the pair of top legs 28 has a top hinge 30 coupled to either the top left side 14 or the top right side 16 adjacent the top lower face 24. Each of the pair of top legs 28 swingingly moves between a top folded position 32 adjacent the top lower face 24 and an alternate top extended position 34 coplanar with either the top left side 14 or the top right side 16. Each of the pair of top legs 28 has a top outer channel 36 adjacent a top proximal edge 38 and a top inner channel 40 adjacent a top distal edge 42. The top outer channel 36 and the top inner channel 40 extend from a top front edge 43 to a top back edge 44. The top outer channel 36 receives either the top left side 14 or the top right side 16 in the alternate top extended position 34 and the top inner channel 40 receives the raised section 26 of the top lower face in the top folded position 32.

A bottom table 46 has a bottom left side 48, a bottom right side 50, a bottom front side 52, a bottom back side 54, a bottom upper face 56, and a bottom lower face 58. The bottom front side 52 and the bottom back side 54 perpendicularly extend beyond the bottom upper face 56. A pair of bottom legs 60 is coupled to the bottom table 46. Each of the pair of bottom legs 60 has a bottom hinge 62 coupled to either the bottom front side 52 or the bottom back side 54 adjacent the bottom upper face 56. Each of the pair of bottom legs 60 has a bottom left edge 64 and a bottom right edge 66 inset from the bottom left side 48 and the bottom right side 50, respectively. The inset corresponds to a thickness 68 of the top distal edge. Each of the pair of bottom legs 60 swingingly moves between a bottom folded position 70 adjacent the bottom upper face 56 and an alternate bottom extended position 72 coplanar with either the bottom front side 52 or the bottom back side 54. Each of the pair of bottom legs 60 has a bottom outer channel 74 adjacent a bottom proximal edge 76. The bottom outer channel 74 extends from the bottom left edge 64 to the bottom right edge 66. The bottom outer channel 74 receives either the bottom front side 52 or the bottom back side 54 in the alternate bottom extended position 72. The bottom front side 52, the bottom back side 54, and the bottom outer channel 74 each having a corresponding rounded profile. The rounded profile of the bottom outer channel 74 of each of the pair of bottom legs engages the rounded profile of either the bottom front side 52 or the bottom back side 54 to maintain the alternate bottom extended position 72.

A storage configuration 76 is defined by the bottom table 46 with the pair of bottom legs 60 in the bottom folded position 70 receiving the top table 12 with the pair of top legs 28 in the top folded position 32 on the bottom upper face 56 between the bottom front side 52 and the bottom back side 54 to form a rectangular prism. An alternate box configuration 78 is defined by the top distal edge 42 of the pair of top legs in the alternate top extended position 34 engaging the bottom upper face 56 between the bottom front side 52 and the bottom back side 54 to form a rectangular prism with an open front and an open back.

A plurality of first locking mechanisms 80 is coupled to the top front edge 43, the top rear edge 44, and the top inner channel 40 of each of the pair of top legs. Each of the plurality of first locking mechanisms 80 may be a protrusion. A plurality of second locking mechanisms 82 is coupled to the bottom left edge 64 and the bottom right edge 66 of each of the pair of bottom legs, the bottom front side 52, the bottom back side 54, and the raised section 26 of the top lower face. The first locking mechanisms 80 of the top front edge 43 and the top rear edge 44 are selectively engageable with second locking mechanisms 82 of the bottom front side 52 and the bottom back side 54, respectively, to maintain the storage configuration 76. The first locking mechanisms 80 of the top inner channel 40 are selectively engageable with the second locking mechanisms 82 of the bottom left edge 64 and the bottom right edge 66 to maintain the alternate box configuration 78. The first locking mechanisms 80 of the top inner channel 40 are selectively engageable with the second locking mechanisms 82 of the raised section 26 to maintain the top folded position 32. Each of the plurality of second locking mechanisms 82 may be a depression.

In use, the foldable lap table assembly 10 may be stored or used as a low surface in the storage configuration 76. The top table 12 may be used as a high surface with the pair of top legs 28 in the alternate top extended position 34 and the bottom table 46 may be inverted and used as a medium height surface with the pair of bottom legs 60 in the alternate bottom extended position 72. The alternate box configuration 78 may be used to create a lap table.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A foldable lap table assembly comprising:

a top table having a top left side, a top right side, a top front side, a top back side, a top upper face, and a top lower face, the top left side and the top right side perpendicularly extending beyond the top lower face, the top lower face having a raised section extending from the top front side to the top back side medially positioned between the top left side and the top right side;

a pair of top legs coupled to the top table, each of the pair of top legs having a top hinge coupled to either the top left side or the top right side adjacent the top lower face, each of the pair of top legs swingingly moving between a top folded position adjacent the top lower face and an alternate top extended position perpendicular to the top lower face, each of the pair of top legs having a top outer channel adjacent a top proximal edge and a top inner channel adjacent a top distal edge, the top outer channel and the top inner channel extending from a top front edge to a top back edge, the top outer channel receiving either the top left side or the top right side in the alternate top extended position and the top inner channel receiving the raised section of the top lower face in the top folded position;

a bottom table having a bottom left side, a bottom right side, a bottom front side, a bottom back side, a bottom upper face, and a bottom lower face, the bottom front side and the bottom back side perpendicularly extending beyond the bottom upper face; and a pair of bottom legs coupled to the bottom table, each of the pair of bottom legs having a bottom hinge coupled to either the bottom front side or the bottom back side adjacent the bottom upper face, each of the pair of bottom legs swingingly moving between a bottom folded position adjacent the bottom upper face and an alternate bottom extended position perpendicular to the bottom upper face, each of the pair of bottom legs having a bottom outer channel adjacent a bottom proximal edge, the bottom outer channel extending from a bottom left edge to a bottom right edge, the bottom outer channel receiving either the bottom front side or the bottom back side in the alternate bottom extended position;

wherein a storage configuration is defined by the bottom table with the pair of bottom legs in the bottom folded position receiving the top table with the pair of top legs in the top folded position on the bottom upper face between the bottom front side and the bottom back side to form a rectangular prism, and an alternate box configuration is defined by the top distal edge of the pair of top legs in the alternate top extended position engaging the bottom upper face between the bottom front side and the bottom back side to form a rectangular prism with an open front and an open back.

2. The foldable lap table assembly of claim 1 further comprising the bottom left edge and the bottom right edge of each of the pair of bottom legs being inset from the bottom left side and the bottom right side of the bottom table, respectively, the inset corresponding to a thickness of the top distal edge.

3. The foldable lap table assembly of claim 1 further comprising the bottom front side, the bottom back side, and the bottom outer channel of each of the pair of bottom legs having a corresponding rounded profile, the rounded profile of the bottom outer channel of each of the pair of bottom legs engaging the rounded profile of either the bottom front side or the bottom back side to maintain the alternate bottom extended position.

4. The foldable lap table assembly of claim 1 further comprising a plurality of first locking mechanisms coupled to the top front edge, the top rear edge, and the top inner channel of each of the pair of top legs, and a plurality of second locking mechanisms coupled to the bottom left edge and the bottom right edge of each of the pair of bottom legs, the bottom front side, the bottom back side, and the raised section of the top lower face, the first locking mechanisms of the top front edge and the top rear edge being selectively engageable with second locking mechanisms of the bottom front side and the bottom back side, respectively, to maintain the storage configuration, the first locking mechanisms of the top inner channel being selectively engageable with the second locking mechanisms of the bottom left edge and the bottom right edge to maintain the alternate box configuration, and the first locking mechanisms of the top inner channel being selectively engageable with the second locking mechanisms of the raised section to maintain the top folded position.

5. The foldable lap table assembly of claim 4 further comprising each of the plurality of first locking mechanisms being a protrusion and each of the plurality of second locking mechanisms being a depression.

6. A foldable lap table assembly comprising:

a top table having a top left side, a top right side, a top front side, a top back side, a top upper face, and a top lower face, the top left side and the top right side perpendicularly extending beyond the top lower face, the top lower face having a raised section extending from the top front side to the top back side medially positioned between the top left side and the top right side;

a pair of top legs coupled to the top table, each of the pair of top legs having a top hinge coupled to either the top left side or the top right side adjacent the top lower face, each of the pair of top legs swingingly moving between a top folded position adjacent the top lower face and an alternate top extended position perpendicular to the top lower face, each of the pair of top legs having a top outer channel adjacent a top proximal edge and a top inner channel adjacent a top distal edge, the top outer channel and the top inner channel extending from a top front edge to a top back edge, the top outer channel receiving either the top left side or the top right side in the alternate top extended position and the top inner channel receiving the raised section of the top lower face in the top folded position;

a bottom table having a bottom left side, a bottom right side, a bottom front side, a bottom back side, a bottom upper face, and a bottom lower face, the bottom front side and the bottom back side perpendicularly extending beyond the bottom upper face;

a pair of bottom legs coupled to the bottom table, each of the pair of bottom legs having a bottom hinge coupled to either the bottom front side or the bottom back side adjacent the bottom upper face, each of the pair of bottom legs having a bottom left edge and a bottom right edge inset from the bottom left side and the bottom right side of the bottom table, respectively, the inset corresponding to a thickness of the top distal edge, each of the pair of bottom legs swingingly moving between a bottom folded position adjacent the bottom upper face and an alternate bottom extended position perpendicular to the bottom upper face, each of the pair of bottom legs having a bottom outer channel adjacent a bottom proximal edge, the bottom outer channel extending from the bottom left edge to the bottom right edge, the bottom outer channel receiving either the bottom front side or the bottom back side in the alternate bottom extended position, the bottom front side, the bottom back side, and the bottom outer channel each having a corresponding rounded profile, the rounded profile of the bottom outer channel of each of the pair of bottom legs engaging the rounded profile of either the bottom front side or the bottom back side to maintain the alternate bottom extended position;

wherein a storage configuration is defined by the bottom table with the pair of bottom legs in the bottom folded position receiving the top table with the pair of top legs in the top folded position on the bottom upper face between the bottom front side and the bottom back side to form a rectangular prism, and an alternate box configuration is defined by the top distal edge of the pair of top legs in the alternate top extended position engaging the bottom upper face between the bottom front side and the bottom back side to form a rectangular prism with an open front and an open back;

a plurality of first locking mechanisms coupled to the top front edge, the top rear edge, and the top inner channel of each of the pair of top legs, each of the plurality of first locking mechanisms being a protrusion; and a plurality of second locking mechanisms coupled to the bottom left edge and the bottom right edge of each of the pair of bottom legs, the bottom front side, the bottom back side, and the raised section of the top lower face, the first locking mechanisms of the top front edge and the top rear edge being selectively engageable with second locking mechanisms of the bottom front side and the bottom back side, respectively, to maintain the storage configuration, the first locking mechanisms of the top inner channel being selectively engageable with the second locking mechanisms of the bottom left edge and the bottom right edge to maintain the alternate box configuration, and the first locking mechanisms of the top inner channel being selectively engageable with the second locking mechanisms of the raised section to maintain the top folded position, each of the plurality of second locking mechanisms being a depression.

* * * * *